United States Patent [19]

Glucksman et al.

[11] 4,132,885

[45] Jan. 2, 1979

[54] ELECTRIC SPACE HEATER

[76] Inventors: Dov Z. Glucksman, 43 Norwood Ave., Newton, Mass. 02159; Karl H. Weidemann, 1580 Beacon St., Brookline, Mass. 02146

[21] Appl. No.: 854,045

[22] Filed: Nov. 22, 1977

[51] Int. Cl.[2] ..... F24H 9/02

[52] U.S. Cl. ..... 219/345; 165/131; 219/365; 219/530; 219/540

[58] Field of Search ..... 219/530, 540, 365, 342, 219/345, 377, 354, 411, 405, 553; 165/183, 131; 23/157.3 D, 157.3 R; 338/254, 51, 52, 58-60, 277, 334

[56] References Cited

U.S. PATENT DOCUMENTS

| | | | |
|---|---|---|---|
| 2,019,913 | 11/1935 | Kotrbaty | 219/365 |
| 2,623,154 | 12/1952 | Suhr | 219/365 |
| 2,636,970 | 4/1953 | Jackson et al. | 219/530 |
| 2,858,402 | 10/1958 | Griffes et al. | 338/58 |
| 3,611,534 | 10/1971 | Keith | 165/183 |

*Primary Examiner*—J. V. Truhe
*Assistant Examiner*—Bernard Roskoski
*Attorney, Agent, or Firm*—John S. Roberts, Jr.

[57] ABSTRACT

A space heater comprises a heater plate made of a metal sheet provided with vertical corrugations, the corrugations in the bottom portion of the sheet being compressed to a flat strip of a thickness not less than three times the thickness of the sheet. The corrugations are so dimensioned that the unfolded length of the metal sheet is three times the length of the corrugated length of the heater body. One, two or more electric flat heating elements are laid along the compressed bottom edge and pressed against it by a U-shaped retaining channel. When serving as a room air-heater, the heater plate is covered on one or both sides by protective panels to prevent people from touching the hot plate and to increase convective air current flow.

7 Claims, 3 Drawing Figures

ELECTRIC SPACE HEATER

BACKGROUND OF THE INVENTION

Most of the existing electric space heaters or convection heaters comprise a vertical heat-dissipation plate and horizontally positioned heating elements in intimate contact therewith. This contact is achieved in different ways. Most heaters utilize a flat plate that is shaped to form longitudinal cavities suited for insertion of electrically insulated resistors of circular or other cross section. Finned or corrugated sheets are frequently attached to one or both sides of the flat plate in intimate contact therewith, in order to increase the heat exchange surface and to cause increased circulation of air by the so-called funnel effect. Most heaters are, in addition, provided with outer protective panels to prevent people from being injured by the hot surface. The flat plate used is either single and rolled up at its lower end into a tube for receiving the heating element, or it onsists of two sheets closely connected over their entire surfaces, each sheet being provided with pressed-out bulges which, together with corresponding bulges on the other sheet form closed tubular cavities for the heating elements.

The main drawback of the known heaters is the fact that these are assembled from different, separate parts, viz. a vertical flat plate and finned or corrugated sheets attached thereto. Unless connection between these parts is by welding or soldering, heat transfer from the plate to the corrugated sheets is unsatisfactory, and since soldering or welding is expensive and ofter causes warping of the connected parts, it is generally not in use with these heaters. In any case, making a heater of many parts increases the manufacturing costs, while a heater composed of one plate only, with heating elements incorporated in the plate, would necessitate a great length in order to create the required heating surface.

In view of these drawbacks it is the object of the present invention to provide an electric heater having a relatively large heat dissipating surface concentrated over a relatively short overall length of the unit. Another object of the invention is to provide an inexpensive heater assembled from a minimum of separate components, and to simplify manufacturing by using bending and pressing operations only, without the necessity to connect heat dissipating surfaces only, without the necessity to connect heat dissipating surfaces by soldering, welding or bolting. Still another object is to permit manufacture of the main component in endless lengths and to cut it to the length required for a given heat exchange surface.

SUMMARY OF THE INVENTION

The space heater, according to the present invention, comprises a vertical heater plate consisting of a heat-conducting metal sheet of a horizontal dimension substantially greater than its vertical dimension, provided over its entire length with vertically extending, evenly spaced corrugations the depth and shape of said corrugations being designed so that the unfolded length of the sheet is not more than three times the horizontal dimension of the corrugated heater plate, the corrugations in the bottom portion of the plate being compressed into a flat strip of a thickness not less than three times the thickness of the sheet metal forming the heater plate, one or more heating elements in the shape of a flat, electrically insulated resistors of a length substantially equal to the length of the heater plate, in intimate contact with one or both sides of the flat strip in the bottom portion of the said heater plate, force means for applying a steady pressure on the electric heating element or elements to bias it against the flat portion of the heater plate.

In a space heater adapted to serve as a room air heater, the heater plate is advantageously covered on one or both sides by paneling with the object of protecting a person against direct contact with the hot heater plate, on the one hand, and to form together with the corrugation closed vertical channels or flues to improve natural draft of the heated air, on the other hand.

The corrugations may be in the shape of a continuous trapezoidal or sinusoidal wave.

The electric heating elements are preferably pressed against the surface of the heater plate by means of a retaining channel of U-shaped cross section positioned over the bottom portion of the heater plate from below and embracing both the heating elements and the compressed strip of the metal sheet forming the heater plate.

With the aim to provide a steady, unrelenting pressure onto the heating elements, a felt-like, resilient and heat-resisting material such as e.g. glass wool, is positioned between the inside of the U-shaped channel and the said heating elements on one or both sides of the compressed bottom strip of the heater plate.

BRIEF DESCRIPTION OF THE DRAWING

In the accompanying drawing which illustrates, by way of example only, one embodiment of the invention.

DESCRIPTION OF A PREFERRED EMBODIMENT

Figure 1:
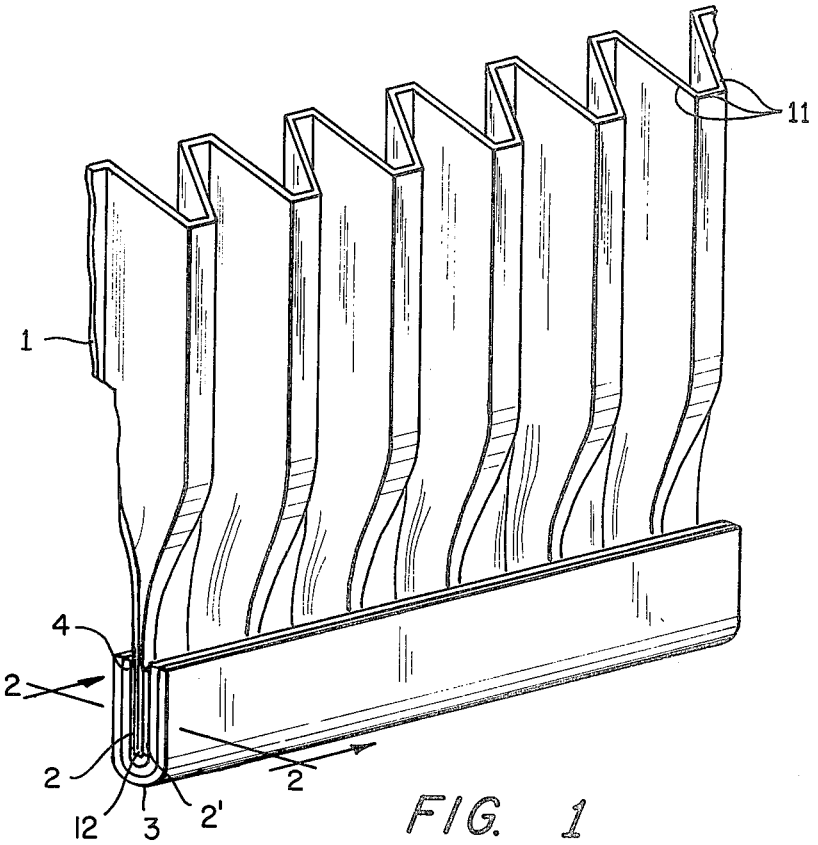
FIG. 1 is a perspective view of a portion of a heater plate.
Figure 2:
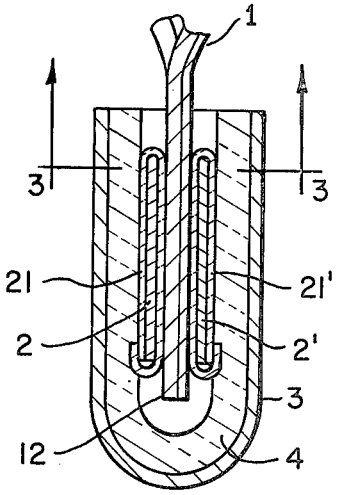
FIG. 2 is a vertical section along 2—2 of FIG. 1.
Figure 3:
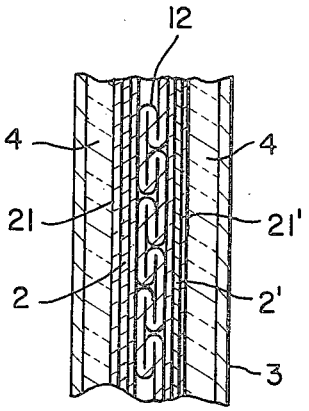
FIG. 3 is a horizontal section along 3—3 of FIG. 2.

With reference to FIG. 1 a heater plate consists of a sheet 1 of a heat conducting metal such as aluminum, shaped in the form of vertical trapezoidal corrugations 11. The corrugations are so dimensioned that in folded state the length of the heater plate is substantially equal to one third of the unfolded lengh of the sheet; this permits the folding of the bottom edge of the sheet by compression into a three-layered strip 12 without the creation of overlapping edges, as is clearly indicated in FIG. 3.

Along each vertical surface of the compressed strip 12 a flat heating element is in intimate contact therewith, which elements consist of an electric resistor 2, 2' each surrounded by electric insulation 21, 21'. The heating elements are pressed onto the heater plate surface by a retaining channel 3 of strong sheet material of U-shaped cross-section which is positioned over the bottom edge of the heater plate from below and covers both heating elements. An intermediate sheet 4 of a felt-like, resilient and heat-resisting material, e.g. glass wool, is positioned between the respective surfaces of the heating elements and the channel walls 3 in order to neutralize any movement of the expanding or contracting components due to temperature changes, thus keeping uniform and steady pressure on the heating elements.

An outer envelope may cover the heater plate on one or both sides, but is not shown in the drawing for clarity's sake.

Only one embodiment of the heater plate has been shown and described in the foregoing, but many modifications and alterations may be carried out to it within the spirit of the invention.

Instead of two electric heating elements only one may be provided and attached to one surface of the compressed bottom strip or, conversely, three or four similar elements may be attached in paralled alignment.

The corrugations may be in any other shape than indicated; they may have a cross section in the form of a sinusoidal curve or any other shape lending itself to easy fabrication. Another important point regarding the shape of the corrugations is the feasibility of compressing the bottom edge into a three-layered strip without overlapping of the edges.

The intermediate insulating sheet 4 may be omitted altogether, provided the material of the retaining channel is sufficiently resilient, also at higher temperatures, to keep up the pressure against the heating elements.

I claim:

1. An electric space heater comprising a vertical heater plate consisting of a heat-conducting metal sheet of a horizontal dimension substantially greater than its vertical dimension, provided over its entire length with vertically extending, evenly spaced corrugations, the depth and shape of said corrugations being designed so that the unfolded length of the sheet is not more than three times the horizontal dimension of the corrugated heater plate, the corrugations in the bottom portion of the plate being compressed into a flat strip of a thickness not less than three times the thickness of the sheet metal forming the heater plate, at least one heating element in the shape of a flat, electrically insulated resistor of a length substantially equal to the length of the heater plate, in intimate contact with the flat strip in the bottom portion of the said heater plate, force means for applying a steady pressure on the electric heating element to bias it against the flat portion of the heater plate.

2. An electric space heater as defined in claim 1 comprising two or more heating elements in the shape of flat, electrically insulated resistors of a length substantially equal to the length of the heater plate, in intimate contact with both sides of the flat strip in the bottom portion of the said heater plate, force means for applying a steady pressure on the electric heating elements to bias them against the flat portion of the heater plate.

3. An electric space heater as defined in claim 1 wherein the corrugations of the heater plate have a horizontal cross section in the shape of a continuous trapezoidal curve.

4. An electric space heater as defined in claim 1 wherein the corrugations of the heater plate are in the shape of a continuous sinusoidal curve.

5. A space heater as defined in claim 1 adapted to serve as a room air-heater wherein the sides of the heater plate are covered by paneling.

6. An electric space heater as defined in claim 1 wherein a retaining channel of U-shaped cross section is positioned from below over the compressed bottom portion of the heater and the heating elements attached thereto.

7. An electric space heater as defined in claim 6 wherein a sheet of a flat-like resilient and heat resisting material is positioned between the inside of the U-shaped retaining channel and the said heating elements.

* * * * *